United States Patent [19]

Shank

[11] Patent Number: 4,855,968

[45] Date of Patent: Aug. 8, 1989

[54] TIME INTERVAL MEASUREMENT SYSTEM FOR ANALOG OSCILLOSCOPE

[75] Inventor: Gordon W. Shank, Portland, Oreg.

[73] Assignee: Tektronix, Inc., Beaverton, Oreg.

[21] Appl. No.: 213,645

[22] Filed: Jun. 30, 1988

[51] Int. Cl.[4] ..... G04F 8/00

[52] U.S. Cl. ..... 368/115

[58] Field of Search ..... 368/115, 116–120

[56] References Cited

U.S. PATENT DOCUMENTS

| | | | |
|---|---|---|---|
| 4,053,937 | 10/1977 | Hersey, Jr. | 368/115 |
| 4,105,932 | 8/1978 | Cleary, Jr. et al. | 368/115 |
| 4,350,953 | 9/1982 | Best et al. | 368/115 |

*Primary Examiner*—Bernard Roskoski

*Attorney, Agent, or Firm*—Daniel J. Bedell; Peter J. Meza

[57] ABSTRACT

An oscilloscope automatically measures an interval between first and second triggering events in a repetitive input signal. The oscilloscope includes A and B sweep circuits for generating event triggered "A" and "B" sweep ramps, respectively. The oscilloscope also includes two comparators. One comparator generates an "A" indicating signal when the A sweep ramp reaches the level of a first adjustable reference signal. The other comparator generates a "B" indicating signal when the B sweep ramp reaches the level of a second adjustable reference signal. The oscilloscope initially sets both sweep circuit to repetitively trigger on the first event and sets the first reference signal to a constant level. While monitoring relative timing of the A and B indicating signals, the oscilloscope iteratively adjusts the second reference signal to a "first pass" level for which the A and B indicating signals are repetitively generated at substantially similar times. Thereafter, the B sweep ramp is set to repetitively trigger on the second triggering event while the A sweep ramp continues to repetitively trigger on the first triggering event. The oscilloscope then iteratively adjusts the second reference signal to a "second pass" level at which the A and B indicating signals are again generated at substantially similar times. The difference between the first and second pass levels is proportional to, and therefore a measure of, the interval between the first and second trigger events.

7 Claims, 11 Drawing Sheets

TIME INTERVAL MEASUREMENT SYSTEM FOR ANALOG OSCILLOSCOPE

BACKGROUND OF THE INVENTION

This invention relates generally to interval timer systems and more particularly to a system employing oscilloscope trigger and sweep circuitry to automatically measure time intervals between events in an input signal.

Operators often use an oscilloscope to measure a time interval between events in an input signal. An "event" is usually a point at which the input signal reaches a particular magnitude. For example, the period of a sine wave signal can be determined by measuring the interval between zero crossings. The rise time of a square wave signal can be determined according to the interval between 10% and 90% of its peak level. Traditionally such measurements are made utilizing display of a waveform representation of the input signal on an oscilloscope screen. An operator determines the interval between the two events through measurement of the horizontal distance between the two events on the oscilloscope screen in units of "horizontal divisions" of a rectangular grid system superimposed over the waveform display. The operator then multiples the distance by the sweep rate of the oscilloscope expressed in units of time/division to obtain the time interval. This time interval measurement method is not only slow but is often relatively inaccurate because the operator is unable to gauge distances properly.

SUMMARY OF THE INVENTION

In accordance with an aspect of the present invention, an oscilloscope automatically measures an interval between first and second triggering events in a repetitive input signal. The oscilloscope includes A and B sweep circuits for generating event triggered "A" and "B" sweep ramps, respectively. The oscilloscope also includes one comparator generating an "A" indicating signal when the A sweep ramp reaches the level of a first adjustable reference signal and another comparator generating a "B" indicating signal when the B sweep ramp reaches the level of a second adjustable reference signal. The oscilloscope initially sets both sweep circuits to repetitively trigger on the first event and sets the first reference signal to a constant level. While monitoring relative timing of the A and B indicating signals, the oscilloscope iteratively adjusts the second reference signal to a "first pass" level for which the A and B indicating signals are repetitively generated at substantially similar times. Thereafter, the B sweep ramp is set to repetitively trigger on the second triggering event while the A sweep ramp continues to repetitively trigger on the first triggering event. The oscilloscope then iteratively adjusts the second reference signal to a "second pass" level for which the A and B indicating signals are again generated at substantially similar times. The difference between the first and second pass levels is proportional to, and therefore a measure of, the interval between the first and second trigger events.

It is accordingly an object of the invention to provide an improved method and apparatus for measuring a time interval between two events in an input signal.

The subject matter of the present invention is particularly pointed out and distinctly claimed in the concluding portion of this specification. However, both the organization and method of operation of the invention, together with further advantages and objects thereof, may best be understood by reference to the following description taken in connection with accompanying drawings wherein like reference characters refer to like elements.

DESCRIPTION OF THE PREFERRED EMBODIMENT

The present invention is an improvement with respect to an analog oscilloscope that enables it automatically to provide accurate measurement of time intervals between level crossing events in an input signal. To facilitate understanding of the invention, the structure and operation of relevant aspects of a conventional analog oscilloscope are first described hereinbelow. The improvement in the oscilloscope is described thereafter.

Figure 1:
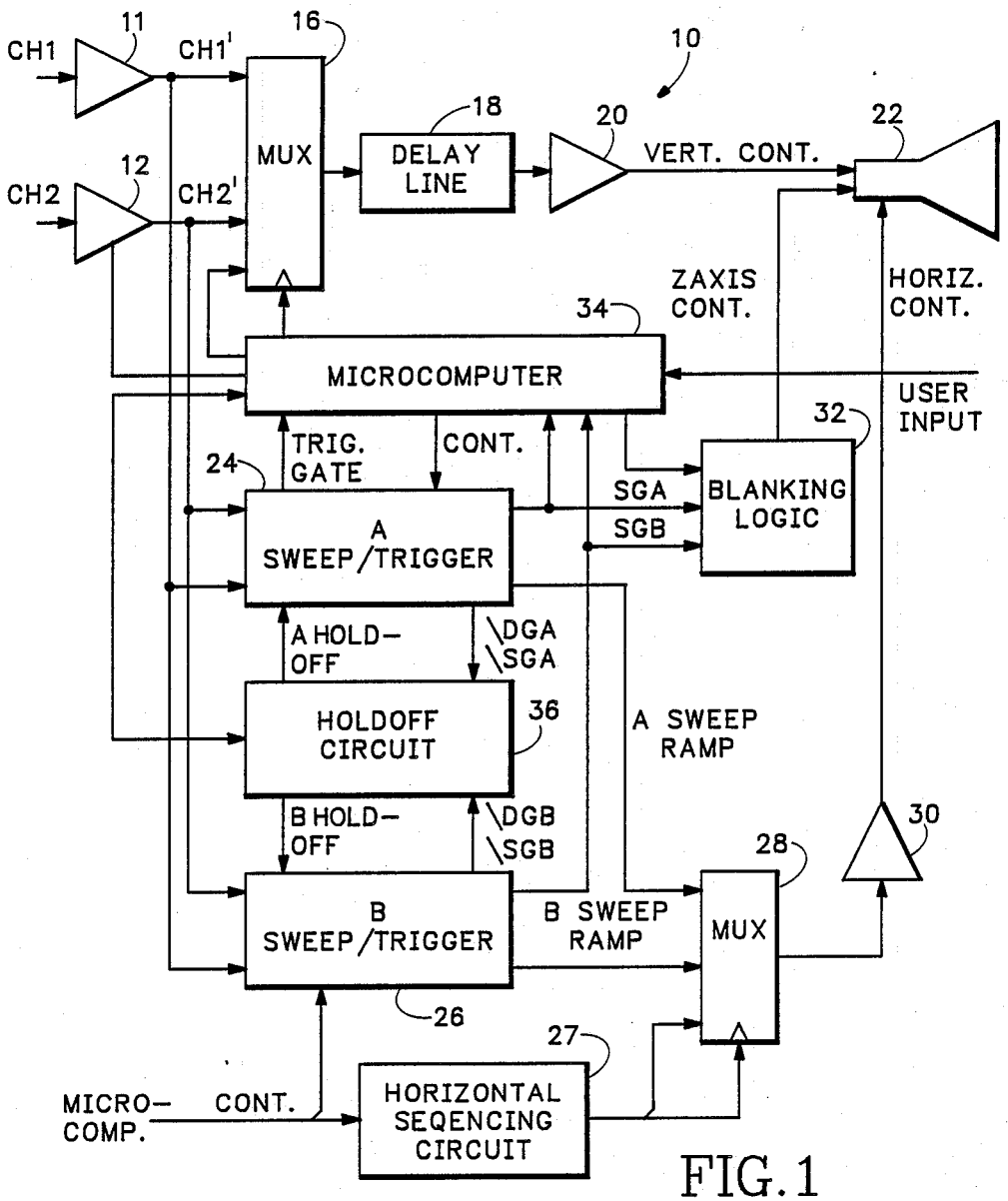
FIG. 1 is a block diagram of an oscilloscope implementing the present invention.

With reference to FIG. 1, an oscilloscope 10 includes a set of two vertical preamplifiers 11 and 12 producing output signals CH1′ and CH2′ that are selectively offset and amplified versions of input channel signals CH1 and CH2, respectively. The output signals from preamplifiers 11 and 12 are provided as inputs to a channel switch (multiplexer) 16. The single output of multiplexer 16 is delayed in a delay line 18 and amplified by a vertical amplifier 20 to produce a vertical control signal for controlling vertical deflection of an electron beam within a cathode ray tube (CRT) 22.

The output signals of preamplifiers 11 and 12 are also connected to parallel inputs of an A sweep/trigger circuit 24 and a B sweep/trigger circuit 26 that respectively generate linearly increasing A and B SWEEP RAMP signals provided as input to a multiplexer 28 controlled by a horizontal sequencing circuit 27. Each sweep/trigger circuit initiates its output SWEEP RAMP signal after a selected one of its input signals CH1′ and CH2′ either rises above or falls below a predetermined trigger level. Multiplexer 28 passes one of the A and B SWEEP RAMP signals as input to an amplifier 30 that produces, in response thereto, a horizontal control signal that controls horizontal deflection of the electron beam in CRT 22. The selected SWEEP RAMP signal supplied as input to horizontal amplifier 30 causes the electron beam to move horizontally at a constant speed across a screen of CRT 22. At the same time, the output signal of vertical amplifier 20 moves the electron beam vertically on the screen in accordance with the magnitude of a selected CH1 or CH2 input signal. Thus, each sweep of the electron beam traces out a waveform on the screen of CRT 22 representing the magnitude of an oscilloscope input signal as a function of time.

The sweep/trigger circuits 24 and 26 also produce sweep gate signals SGA and SGB, respectively, applied as inputs to a blanking logic circuit 32. The SGA or SGB signal is asserted when the corresponding A or B SWEEP RAMP signal is triggered and is deasserted when the corresponding SWEEP RAMP signal reaches a magnitude sufficient to drive the electron beam in CRT 22 to the left side of the screen. Logic circuit 32 provides a "Z-axis" control signal that turns the electron beam on during a sweep operation.

The sweep/trigger circuits 24 and 26 also supply inverted sweep gate signals SGA and SGB and inverted delayed sweep gate signals DGA and DGB applied as inputs to a holdoff circuit 36. (Herein a " " preceding a signal name indicates that the signal is low true.) In response to these signals, the holdoff circuit 36 generates an A HOLDOFF signal supplied as input to the A sweep/trigger circuit 24 and a B HOLDOFF signal supplied as input to the B sweep/trigger circuit 26. The holdoff signals prevent retriggering of the A and B sweep signals until a time after the end of sweep. Details of holdoff circuit 36 are discussed hereinbelow.

The oscilloscope 10 also includes a microcomputer 34 for controlling operation of multiplexer 16, horizontal sequencing circuit 27, blanking logic circuit 32, holdoff circuit 36, and preamplifiers 11, 12, and for adjusting trigger levels and other operating parameters of sweep/trigger circuits 24 and 26 in accodance with operator input via pushbuttons, keyboard or other means. The microcomputer controls additional inputs to blanking logic circuit 32, to multiplexer 16 and, via horizontal sequencing circuit 27, to multiplexer 28. These inputs enable the microcomputer to directly control the electron beam so as to produce data and graphics displays on CRT 22.

The microcomputer 34 can perform an "autoset" procedure wherein it automatically adjusts gain and offset of vertical preamplifiers 11, 12 and the sweep rate of the A and/or B SWEEP RAMP signals so that 2–5 cycles of an input signal are displayed on the CRT screen. A TRIGGER GATE output of the A sweep/-trigger circuit 24 supplies an input to microcomputer 34 and enables the microcomputer to determine peak amplitudes of an input signal. The A sweep/trigger circuit asserts the TRIGGER GATE signal when the input signal rises above or falls below a trigger level set by data supplied by the microcomputer as input to the A sweep/trigger circuit. The microcomputer determines a peak level of a periodic input signal by setting the A sweep/trigger circuit to trigger when the input signal rises above the trigger level, increasing the gain of the appropriate vertical preamplifier until the TRIGGER GATE signal is asserted, and then iteratively adjusting the trigger level while monitoring the TRIGGER GATE signal to determine the minimum trigger level that will allow the sweep/trigger circuit to assert the trigger gate signal. The microcomputer determines a minimum peak level of an input signal by setting the A sweep/trigger circuit to trigger when the input signal falls below the trigger level, decreasing the gain of the appropriate vertical preamplifier until the TRIGGER GATE signal is asserted, and then iteratively adjusting the trigger level while monitoring the TRIGGER GATE signal to determine the maximum trigger level that will allow the sweep/trigger circuit to assert the trigger gate signal. Once the minimum and maximum peak levels are determined, the microcomputer adjusts gain and offset of the preamplifier so that the signal peaks are maximally separated but displayed within the vertical confines of the CRT screen. The microcomputer thereafter sets the trigger level midway between the signal peaks and counts TRIGGER GATE signals generated during a sweep. If more than five TRIGGER GATE signals are counted the sweep rate is increased to the next higher range and the count is repeated. If less than three TRIGGER GATE signals are counted the sweep rate is decreased to the next lower range and the count is repeated.

Figure 2:
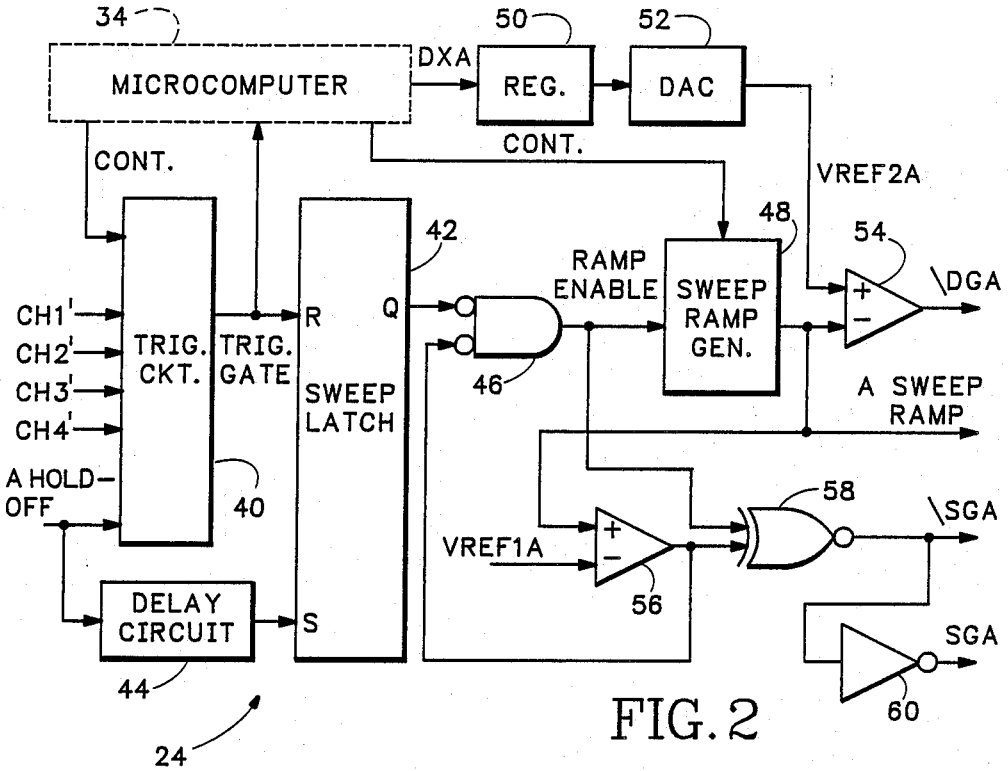
FIG. 2 is a block diagram of the A sweep/trigger circuit of FIG. 1.

The A sweep/trigger circuit 24 of FIG. 1 is shown in more detailed block diagram form in FIG. 2. With reference to FIG. 2, the preamplified vertical input signals CH1', CH2', control data from microcomputer 34 of FIG. 1, and the A HOLDOFF signal from holdoff circuit 36 of FIG. 1 are supplied as inputs to a conventional trigger circuit 40. Trigger circuit 40 asserts an output TRIGGER GATE signal when a selected one of the vertical channel input signals CH1', CH2' selectively rises above or falls below a predetermined trigger level. The A HOLDOFF signal causes the trigger circuit 40 to deassert its TRIGGER GATE output. The control data input to trigger circuit 40 controls selection of input signal CH1' or CH2', sets the trigger level and controls whether the TRIGGER GATE is to be asserted when the input signal rises above or falls below the trigger level.

The TRIGGER GATE signal output of trigger circuit 40 controls a reset input R of a sweep latch 42. The A HOLDOFF signal, delayed by a delay circuit 44, drives a set input S of the sweep latch. When the TRIGGER GATE signal is asserted, the Q output of sweep latch 42 goes low and pulls down an inverting input of an AND gate 46. A RAMP ENABLE output signal of the AND gate then goes high. The RAMP ENABLE signal triggers production of the A SWEEP RAMP signal by a conventionl SWEEP RAMP signal generator 48. The slew rate of the A SWEEP RAMP signal is controlled by control data from the microcomputer.

Data DXA stored in a register 50 by microcomputer 34 of FIG. 1 provides input to a digital-to-analog converter (DAC) 52 producing an output reference signal VREF2A. The reference signal VREF2A is applied to a noninverting input of a comparator 54 and the A SWEEP RAMP signal is applied to an inverting input of comparator 54. When the SWEEP RAMP signal magnitude reaches the level of VREF2A, comparator 54 drives low its output signal, the inverted delayed sweep gate signal DGA. The A SWEEP RAMP signal is also connected to a noninverting input of another comparator 56 and a reference signal VREF1A is applied to the inverting input of comparator 56. VREF1A is set such that when the SWEEP RAMP signal reaches a voltage sufficient to drive the electron beam in the CRT to the right side of the CRT screen, the output of comparator 56 goes high to indicate "end of sweep". The RAMP ENABLE signal output of AND gate 46 and the output of comparator 56 are applied to inputs of an XNOR gate 58 supplying the SGA signal. The SGA signal, which goes low at the start of the A sweep and goes high at the end of the A sweep, is inverted by an inverter 60 to provide the SGA signal. The output of comparator 56 is also coupled to an inverting input of AND gate 46 and prevents retriggering of the RAMP ENABLE signal until after the end of sweep.

The B sweep/trigger circuit 26 of FIG. 1 is substantially similar to the A sweep/trigger circuit of FIG. 2. Hereinafter, data and signals in the B sweep/trigger circuit of FIG. 1 referenced DXB, VREF1B, and VREF2B correspond to and have functions similar to those of data and signals DXA, VREF1A, and VREF2A of the A sweep/trigger circuit of FIG. 2.

Figure 4:
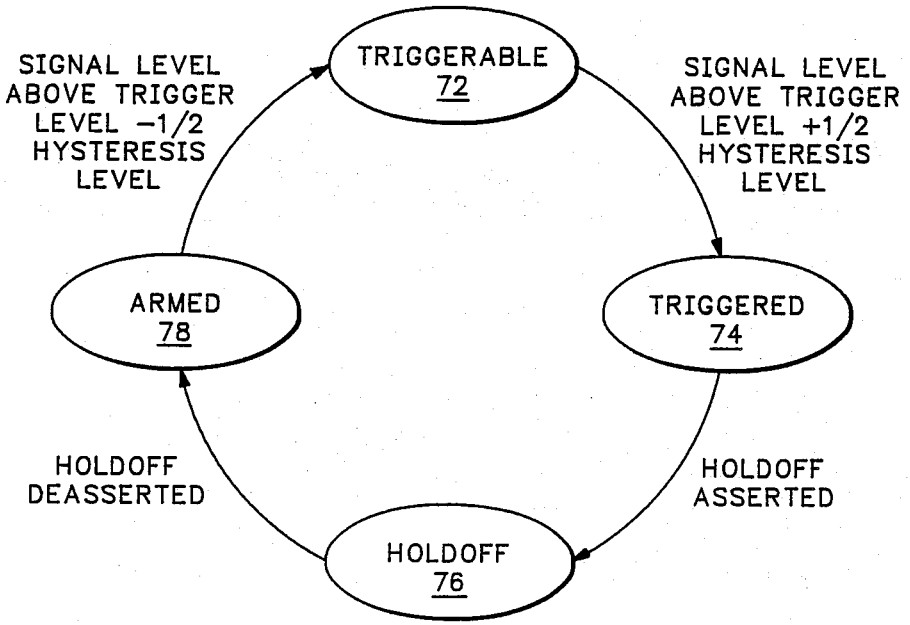
FIG. 4 is a state diagram illustrating operation of the sweep/trigger circuit of FIG. 2.
Figure 3:
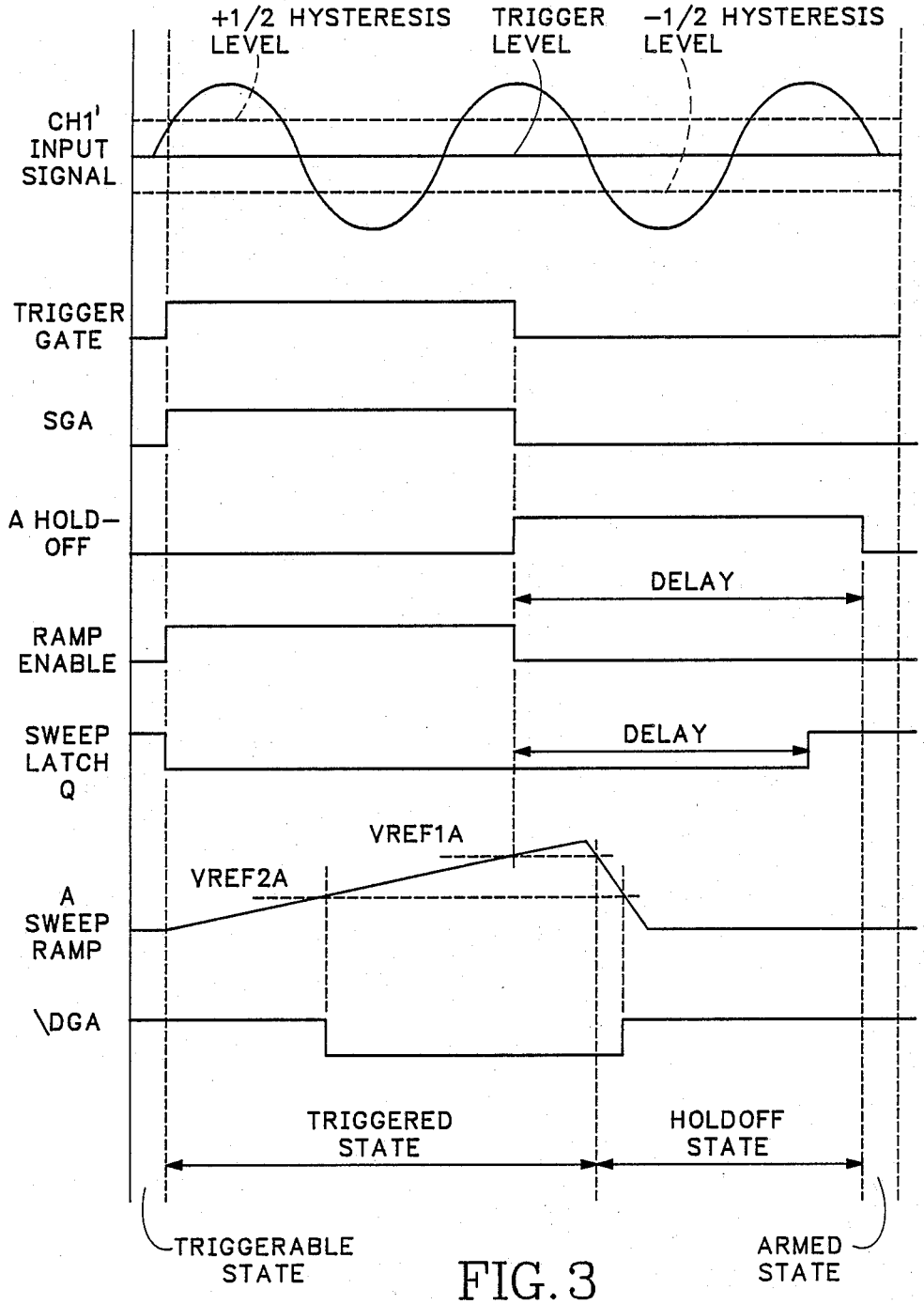
FIG. 3 is a timing diagram illustrating operation of the A sweep/trigger circuit of FIG. 2 during normal operation of the oscilloscope.

FIG. 3 is a timing diagram illustrating operation of the A sweep/trigger circuit of FIG. 2 during normal oscilloscope operation. In an example case illustrated by FIG. 3 the CH1' input signal is a sine wave signal and is selected as the trigger source for the A sweep/trigger circuit. The trigger level is set for the zero crossing of the sine wave signal. As shown in FIG. 3 and further illustrated in FIG. 4, the trigger circuit 40 of FIG. 2 has four operating states. When the input signal level rises above a "$-\frac{1}{2}$ hysteresis" level slightly below the trigger level, the trigger circuit enters a "triggerable" state 72. When the signal level rises above a "$+\frac{1}{2}$ hysteresis" level slightly above the trigger level, the trigger circuit enters a "triggered" state 74 where it asserts its TRIGGER GATE output signal. When the A HOLDOFF signal is subsequently asserted, the trigger circuit enters a "holdoff" state 76 wherein its TRIGGER GATE output signal is deasserted. When the A HOLDOFF signal is subsequently deasserted, the trigger circuit enters an "armed" state 78 and remains in that state until it reenters the triggerable state after the signal level rises above the $-\frac{1}{2}$ hysteresis level. (In FIG. 3 the voltage difference between the $+\frac{1}{2}$ hysteresis level and the $-\frac{1}{2}$ hysteresis level is exaggerated for illustrative purposes and is normally only a small fraction of the peak-to-peak input signal voltage.)

Thus, with reference to FIG. 3, the trigger circuit is "armed" to trigger when the input signal rises above the $-\frac{1}{2}$ hysteresis level, and asserts the TRIGGER GATE signal when the input signal rises above the $+\frac{1}{2}$ hysteresis level. The TRIGGER GATE signal resets the sweep latch 42 of FIG. 2 which in turn drives the RAMP ENABLE signal high. The RAMP ENABLE signal then causes the SWEEP RAMP signal generator 48 of FIG. 2 to initiate the A SWEEP RAMP signal. When the A SWEEP RAMP signal reaches VREF2A, the DGA signal goes low. When the A SWEEP RAMP signal thereafter reaches VREF1A, the RAMP ENABLE signal and the SGA signal go low. The holdoff circuit 36 of FIG. 1 drives the A HOLDOFF signal high when the SGA signal goes low, and the A HOLDOFF signal causes the sweep latch 42 of FIG. 2 to reset, following a delay determined by delay circuit 44 of FIG. 2. The holdoff circuit 36 of FIG. 1 includes a timer that drives the A HOLDOFF signal low again after a predetermined delay time. The DGA signal is driven high after the SWEEP RAMP signal falls below VREF2A.

The holdoff circuit 36 of FIG. 1 controls the B HOLDOFF signal supplied to the B sweep/trigger circuit 26 selectively in response to the inverted A sweep gate signal SGA or in response to the inverted delayed A delay gate signal DGA. When the SGA signal controls holdoff, the B SWEEP RAMP signal produced by the B sweep/trigger circuit 26 is triggered independent of the A SWEEP RAMP signal produced by the A sweep/trigger circuit 24.

When the DGA signal controls the B HOLDOFF signal, the B SWEEP RAMP can only be triggered after the A SWEEP RAMP reaches the level of the VREF2A output of DAC 52 of FIG. 2. This "delayed sweep" mode of operation is particularly useful when the waveform displays produced by the A and B sweeps are based on the same input signal, but the B SWEEP RAMP signal is set for a faster rise time than the A SWEEP RAMP signal so that the B waveform represents a smaller portion of the input signal in an expanded horizontal time scale. To operate in the delayed sweep mode, the microcomputer 34 sets the holdoff circuit 36 of FIG. 1 to control the B HOLDOFF signal in response to the DGA signal and obtains operator input indicating a section of the waveform produced by the A sweep to be expanded. The microcomputer then appropriately sets the slew rate of the B SWEEP RAMP signal and the value of data DXA stored in register 50 of the A sweep/trigger circuit 24 of FIG. 2.

The present invention employs the sweep/trigger and holdoff circuitry of the oscilloscope to provide accurate measurement of time intervals between level crossing events in an input signal. The holdoff circuit 36 of FIG. 1 is illustrated in more detailed block diagram form in FIG. 5. The SGA output of the A sweep/trigger circuit 24 is applied as input to a holdoff timer 80. Timer 80 drives its output A HOLDOFF signal high when the SGA signal goes low and drives the A HOLDOFF signal low a set delay time thereafter. The output of timer 80 and the DGA signal output of A sweep/trigger circuit 24 are switched by a multiplexer 84 to provide the B HOLDOFF signal input to the B-sweep/trigger circuit 26. An inverter 86 inverts the DGB output of sweep/trigger circuit to supply a DGB control signal to a D input of a type D flip-flop 88. The DGA and SGA outputs of the A sweep/trigger circuit 24 are applied to inverting and noninverting inpus of another multiplexer 90 and the output of multiplexer 90, selectively either the DGA or SGA signal, controls a clock input of flip-flop 88. Microcomputer 34 of FIG. 1 controls switching of multiplexers 84 and 90. The A HOLDOFF signal output of timer 80 controls a clear input of flip-flop 88. The Q output of flip-flop 88 drives a set input of a latch 82, and a Q output of latch 82 provides input to microcomputer 34. Microcomputer 34 controls a reset input of latch 82.

During conventional oscilloscope operation, microcomputer 34 switches multiplexer 84 to selectively pass either the DGA signal or the output of timer 80 as the B HOLDOFF signal input to the B sweep/trigger circuit 26, depending on the desired mode of triggering the B sweep. The microcomputer ignores the Q output of latch 82 during conventional oscilloscope operation.

Figure 6A:
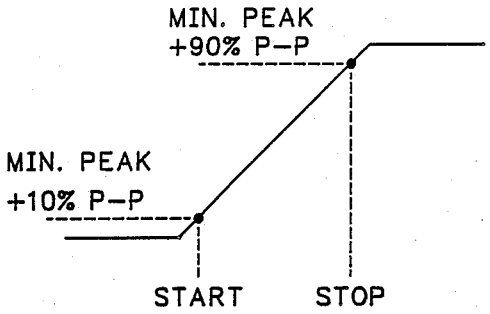
FIGS. 6A–6D are timing diagrams illustrating various triggering events in an input signal marking the beginning and ending of periods to be measured.
Figure 6B:
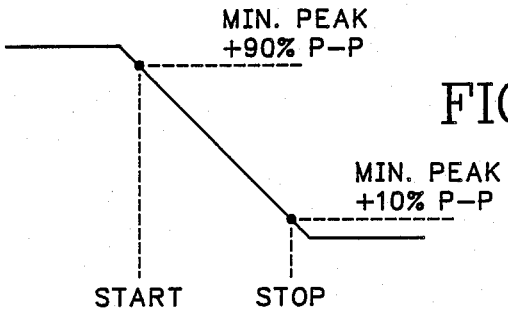
Figure 6C:
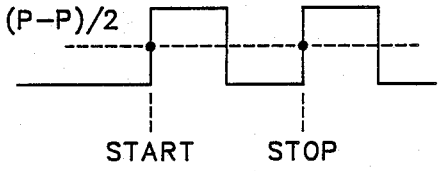
Figure 6D:
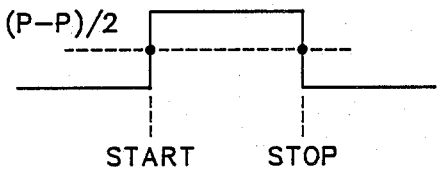

However, when the oscilloscope is to operate in a time interval measurement mode in accordance with the present invention, the Q output of latch 82 is monitored. There are two time interval measurement modes hereinafter referenced as the "A-same-B" mode and the "B-after-A" mode. FIGS. 6A–6B illustrate measurable intervals between start and stop events in an input signal. FIGS. 6A and 6B show start and stop events used to measure rise and fall time intervals between 10% and 90% peak-to-peak levels of an input signal. FIG. 6C illustrates start and stop events utilized to measure a period of a square wave input signal. FIG. 6D shows start and stop events employed in measuring the pulse width of a square wave signal. In FIGS. 6C and 6D the start and stop events occur when the signal rises above or falls below a level half way between the maximum and minimum peaks of the square wave signal.

Figure 7:
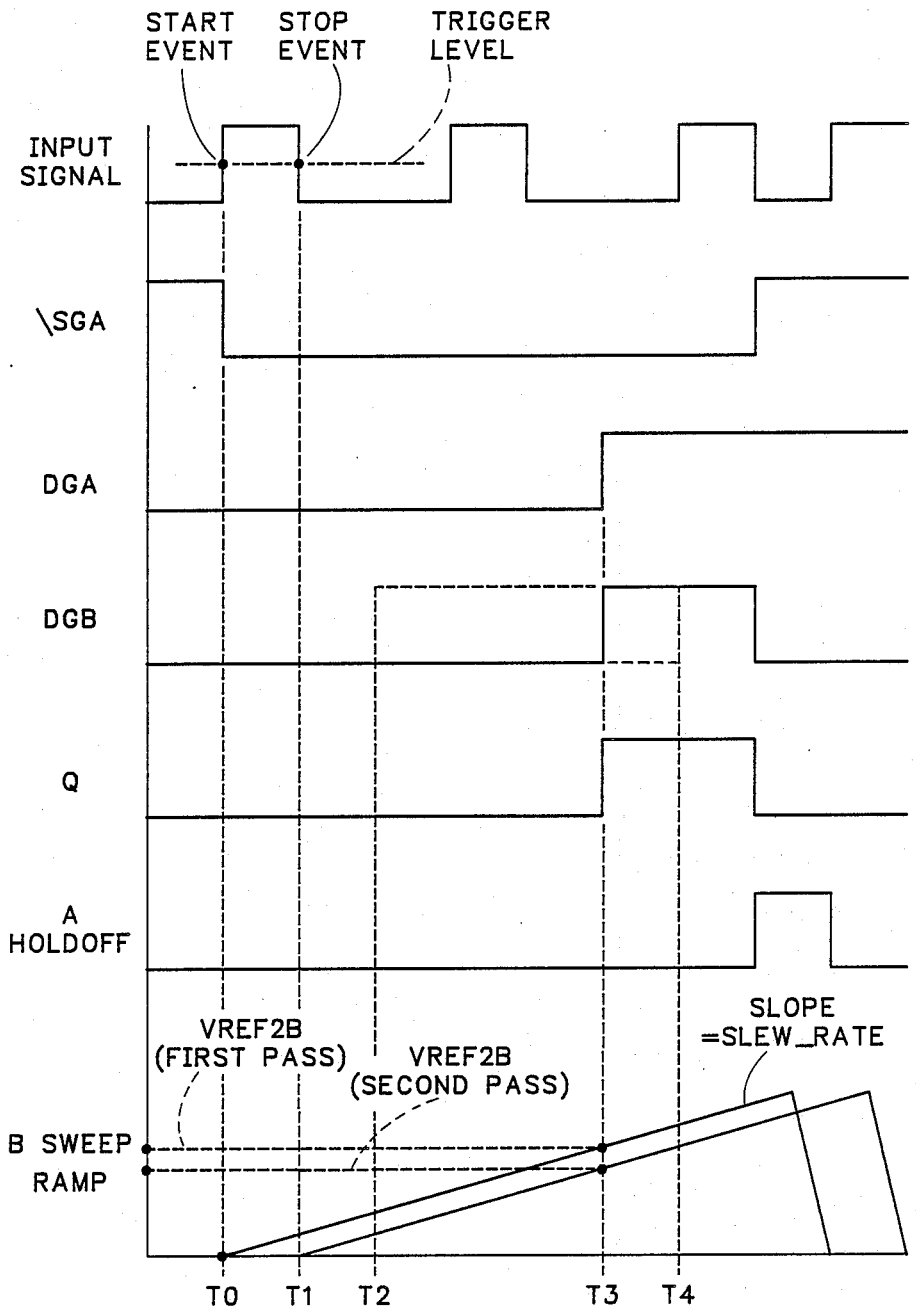
FIGS. 7 and 8 are timing diagrams illustrating operation of the oscilloscope of FIG. 1 during interval measurement operations in accordance with the present invention.

FIG. 7 is a timing diagram illustrating oscilloscope operation in the A-same-B interval measurement mode when measuring the pulse width of a square wave input signal as illustrated in FIG. 6D. The input signal is applied, for example, to the CH1 input of the oscilloscope, and the resulting CH1' output signal of preamplifier 11 of FIG. 1 is selected as the trigger control signal for both the A sweep/trigger circuit 24 and the B sweep/trigger circuit 26 of FIG. 1. Initially operating in the previously described autoset mode, the microcomputer 34 determines peak levels of the square wave input signal and adjusts preamplifier offset and amplification and adjusts sweep rate so that two to five cycles of the input signal are displayed on the CRT. The microcomputer then sets the trigger level for both circuits 24 and 26 to midway between the high and low peaks of the square wave input signal and initially sets both circuits 24 and 26 to trigger at the start event at time T0 as the input signal rises above the trigger level. The SGA signal goes low at time T0. (The trigger circuits actually trigger slightly later when the input signal reaches the previously mentioned $+\frac{1}{2}$ hysteresis level but this level is relatively close to the trigger level when the input signal is preamplified for full scale display. To simplify the timing diagram, the slight delay due to the hysteresis level is not shown.

Referring to FIGS. 1, 2, 5 and 7, the microcomputer adjusts data DXA stored in register 50 of the A sweep/-trigger circuit 4 so that the DGA signal goes high at some time T3 following enabling of the A SWEEP RAMP signal at time T0. The magnitude of DXA in the A sweep/trigger circuit is set such that VREF2A is near but below the magnitude of the A SWEEP RAMP signal at end of sweep. The microcomputer stores an arbitrary data DXB value in a similar register of the B sweep/trigger circuit so that a reference voltage VREF2B in the B sweep/trigger circuit is some arbitrary value. The microcoputer also switches multiplexer 90 of FIG. 5 to pass the DGA signal to the clock input of flip-flop 88. Thereafter, the microcomputer checks the Q output of latch 82 of FIG. 5 when both A and B SWEEP RAMP signals have been triggered and the A and B SWEEP RAMP signals have reached end of sweep. If at end of sweep the Q output of latch 82 is high, then the microcomputer knows that the B SWEEP RAMP signal reached VREF2B at some time T2 before T3. The microcomputer then resets latch 82, changes DXB to adjust VREF2B upward and again checks the Q output of latch 82 following a next end of sweep. If the Q output of latch 82 is low, the microcomputer knows that the B SWEEP RAMP signal reached VREF2B at some time T4 after T3. The microcomputer iteratively adjusts the VREF2B signal of the B sweep/-trigger circuit up or down by progressively smaller amounts until a first value D1 is determined for data DXB controlling VREF2B for B sweep/trigger circuit for which the B SWEEP RAMP signal reaches a "first pass" value of VREF2B at a time as close as possible to T3 where DGA goes high.

The microcomputer then sets the B sweep/trigger circuit so that it triggers the B sweep at time T1 on the falling edge of the input signal while continuing to allow the A sweep/trigger circuit to trigger on the rising edge of the input signal. Threafter, the microcomputer again iteratively adjusts the VREF2B signal of the B sweep/trigger circuit until a second value D2 is determined for data DXB supplied as input to DAC 52 of the B sweep/trigger signal for which the B SWEEP RAMP signal reaches a "second pass" level of VREF2B at a time as close as possible to T3.

The difference between the iteratively determined first and second pass levels of VREF2B is proportional to the time interval T1-T0 between the leading and trailing edges of the input signal pulse. The constant of proportionality is the slew rate of the B sweep signal ("SLEW RATE", expressed in terms of horizontal grid divisions/second). The slew rate is a fixed value known to the microcomputer for each horizontal range (sweep rate) setting of the oscilloscope. The first and second pass levels of the B sweep/trigger circuit VREF2B signal are proportional to the values D1 and D2 of data DXB providing input to DAC 52 when producing the two iteratively determined VREF2B signal levels. The voltage increase in VREF2B with respect to a unit increase in DXB ("VPDXB"), expressed in units of horizontal grid divisions per unit of data, is also a fixed value known to the microcomputer for each horizontal range setting. The microcomputer computes the input signal pulse width (time interval T1-T0) according to the expression:

$$T1\text{-}T0=(D1\text{-}D2)(VPDXB/SLEW\ RATE) \quad [1]$$

Figure 8:
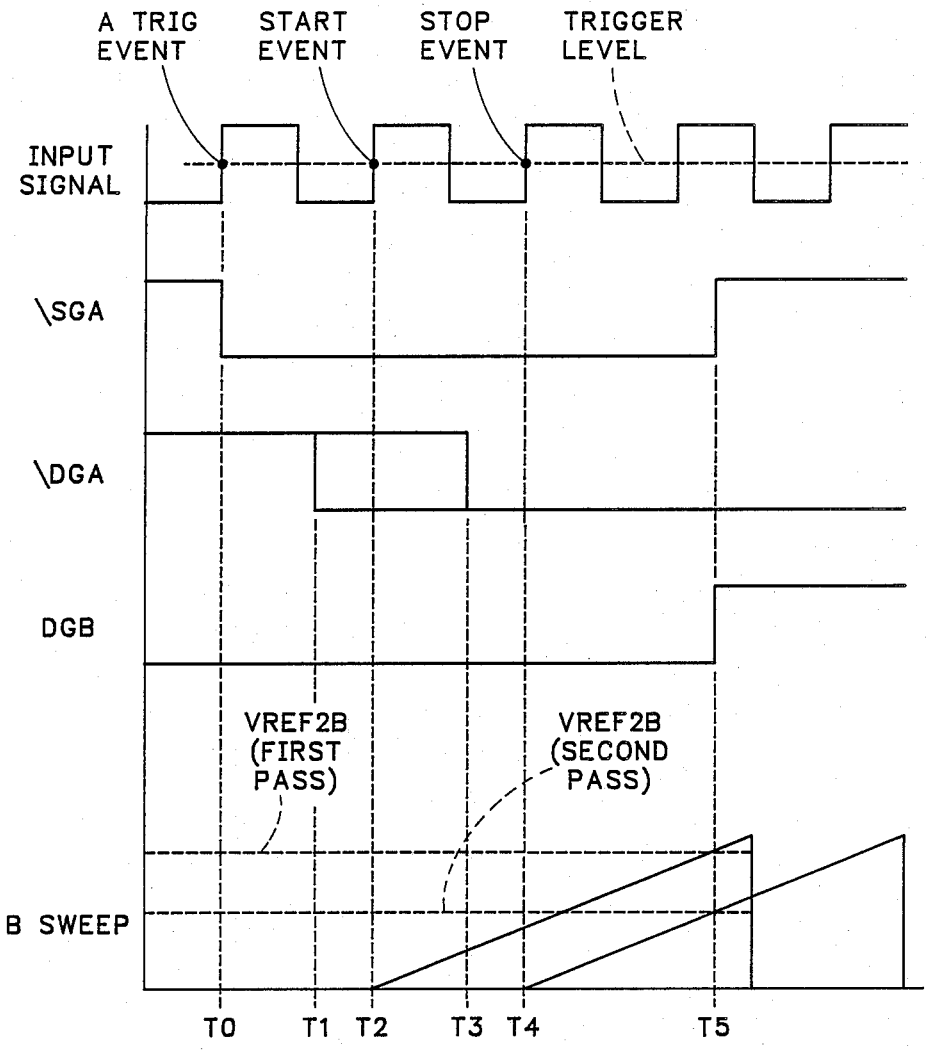

FIG. 8 is a timing diagram illustrating oscilloscope operation in the B-after-A interval measurement mode when measuring the period between two pulses of a square wave input signal. In this mode, the input signal is amplified, for example, by vertical channel preamplifier 11 of FIG. 1, and its output signal CH1' is selected as the trigger control signal for both the A and B sweep/trigger circuits 24 and 26 of FIG. 1. The microcomputer 34 initially autosets the trigger level for both circuits 24 and 26 to midway between the high and low peaks of the input signal and sets both circuits 24 and 26 to trigger as the input signal rises above the trigger level.

Figure 5:
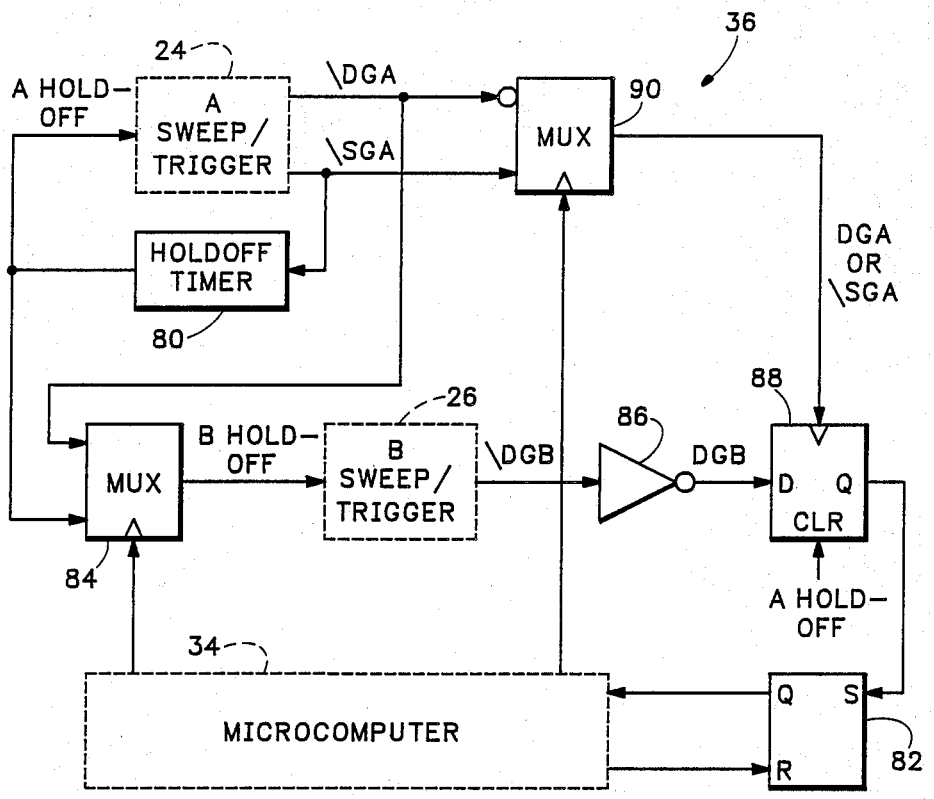
FIG. 5 is a block diagram of the holdoff circuit of FIG. 1.

The microcomputer then switches multiplexer 90 of FIG. 5 to pass the SGA signal to the clock input of flip-flop 88. The microcomputer adjusts the data DXA stored in register 50 of the A sweep/trigger circuit 24 so that the DGA signal goes low at some time T1 following A sweep enable. The SGA signal goes high at a time T5 at the end of the A sweep. The microcomputer also initially stores an arbitrary value in register 50 of the B sweep/trigger circuit whereby VREF2B in the B sweep/trigger circuit is initially arbitrary. The A SWEEP RAMP signal is triggered at time T0 (as indicated in FIG. 8 by the falling edge of the SGA signal) but the B SWEEP RAMP signal is not triggered until a start event at time T2 following the time T1 when DGA goes low. Following end of the A sweep, the microcomputer checks the Q output of latch 82 of FIG. 5. If the Q output of latch 82 is high, then the microcomputer knows the B SWEEP RAMP reached VREF2B at some time before T5. The microcomputer then resets latch 82, adjusts the B sweep/trigger circuit reference voltage VREF2B upward and again checks the Q output of latch 82. If the Q output of latch 82 is low, then the microcomputer knows that the B SWEEP RAMP signal reached VREF2B at some time after T5. The microcomputer iteratively adjusts the VREF2B signal of the B sweep/trigger circuit by progressively smaller amounts until it determines a first value D3 for data DXB supplied as input to the B sweep/trigger circuit for which the B SWEEP RAMP signal reaches a "first pass" value of VREF2B at a time as close as possible to T5.

The microcomputer adjusts the data in the A sweep/-trigger circuit controlling VREF2A such that DGA goes low at a time T3 after the start event at T2. Thus, the B SWEEP RAMP signal is prevented from triggering until the STOP event at time T4. Thereafter, the microcomputer again iteratively adjusts the VREF2B signal of the B sweep/trigger circuit while monitoring the Q output of latch 82 of FIG. 5 after each end of A sweep until it determines a second value D4 for input data DXB of the B sweep/trigger circuit for which the B SWEEP RAMP signal reaches a "second pass" level of VREF2B at a time as close as possible to T5. The difference between the values D3 and D4 that set the iteratively determined first and second pass levels of VREF2B is proportional to the time interval T4-T2 between the start and stop events at the leading edges of successive pulses of the input signal. The constant of proportionality is VPDXB/SLEW RATE. Thus, the microcomputer computes and displays the input signal period (time interval T4-T2) according to the expression:

$$T4\text{-}T2=(D3\text{-}D4)(VPDXB/SLEW\ RATE) \quad [2]$$

Figure 9:
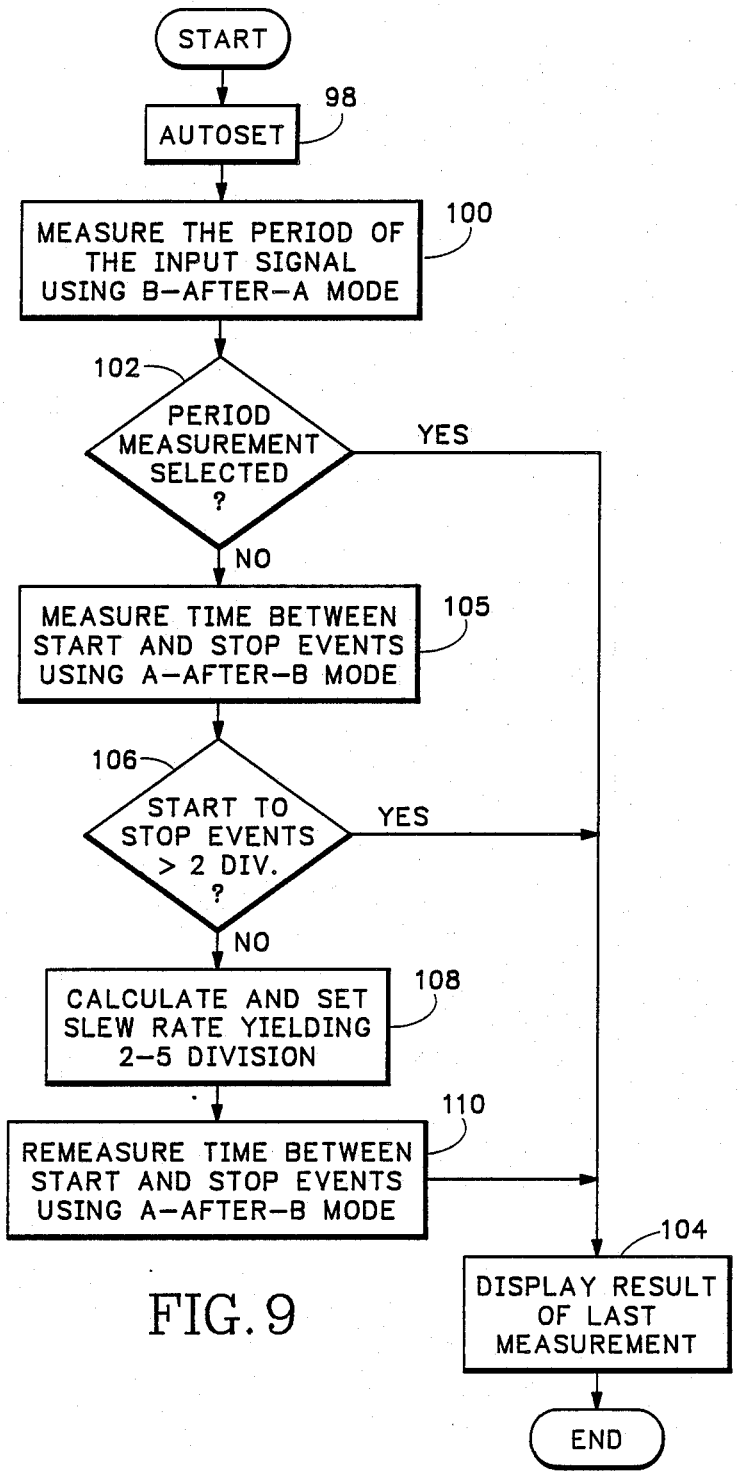
FIGS. 9–11 are flow charts illustrating programming of the microcomputer of FIG. 1 in accordance with the present invention.

FIG. 9 is a flow chart illustrating operation of microcomputer 34 of FIG. 1 to carry out an interval measurement after the user has requested an interval measurement of a type shown in one of FIGS. 6A–6D. The microcomputer initially autosets the amplification and offset of the vertical preamplifier and the sweep rates of the A and B SWEEP RAMP signals whereby 2–5 cycles of the input signal are displayed on the CRT screen by both A and B traces (step 98). The microcomputer then measures the period of the signal using the B-after-A mode (step 100). If the operator had initially selected a period measurement as, for example, shown in FIG. 6C (step 102), the microcomputer displays the result on the CRT screen (step 104). Otherwise, when the user has requested a rise or fall time measurement as illustrated in FIGS. 6A and 6B, or a pulse width measurement as shown in FIG. 6D, the computer measures the time interval between start and stop events using the A-after-B mode (step 105) as described hereinabove and illustrated in FIG. 7. If the interval measured is greater than the time represented by two horizontal grid divisions (step 106), the last measured interval is displayed on the CRT screen (step 104). However, if the interval measured is less than the time represented by two horizontal grid divisions, the microcomputer calculates the slew rate needed to obtain a time interval of 2–5 horizontal divisions, and resets the sweep rate accordingly (step 108). The time interval between start and stop events is then measured again using the A-same-B mode (step 110) and the results displayed on the CRT screen (step 104).

Figure 10:
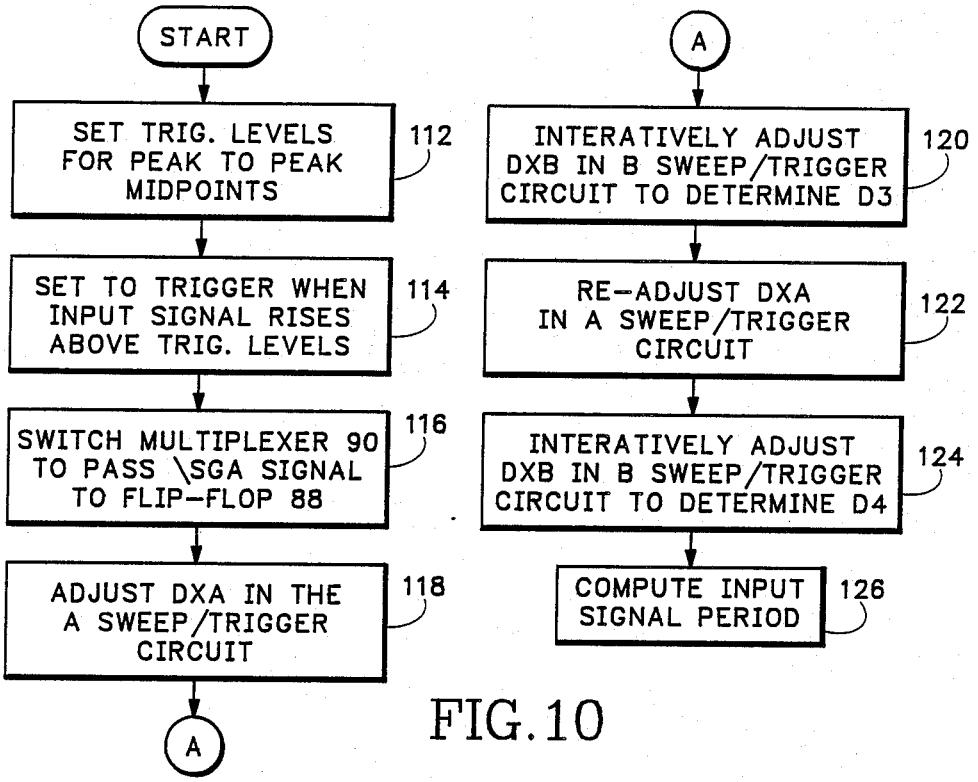

FIG. 10 is a flow chart illustrating operation of the microcomputer to carry out step 100 of the flow chart of FIG. 9. The microcomputer 34 sets the trigger level for both A and B sweep/trigger circuits 24 and 26 to midway between the high and low peaks of the input signal (step 112) and sets both trigger circuits to trigger as the input signal rises above the trigger level (step 114). The microcomputer switches multiplexer 90 of FIG. 5 to pass the SGA signal to the clock input of flip-flop 88 (step 116), and adjusts the data DXA stored in register 50 of the A sweep/trigger circuit 24 whereby the DGA signal goes low following A sweep enable (step 118). The microcomputer then iteratively adjusts the value of DXB in register 50 of the B sweep/trigger circuit until it determines a first value D3 for data DXB supplied as input to the B sweep/trigger circuit for which the Q output of the latch 82 indicates the B SWEEP RAMP signal reaches the first pass value of VREF2B at a time as close as possible to when the SGA signal goes high (step 120). The microcomputer readjusts the data DXA in the A sweep/trigger circuit controlling VREF2A so that DGA goes low at a later time (step 122). Thereafter, the microcomputer again iteratively adjusts the VREF2B signal of the B sweep/trigger circuit while monitoring the Q output of latch 82 until it determines a second value D4 for input data DXB of the B sweep/trigger circuit for which the B SWEEP RAMP signal reaches the "second pass level" of VREF2B at a time as close as possible to when the SGA signal goes high (step 124). The microcomputer then computes the input signal period according expression [2] hereinabove (step 126).

Figure 11:
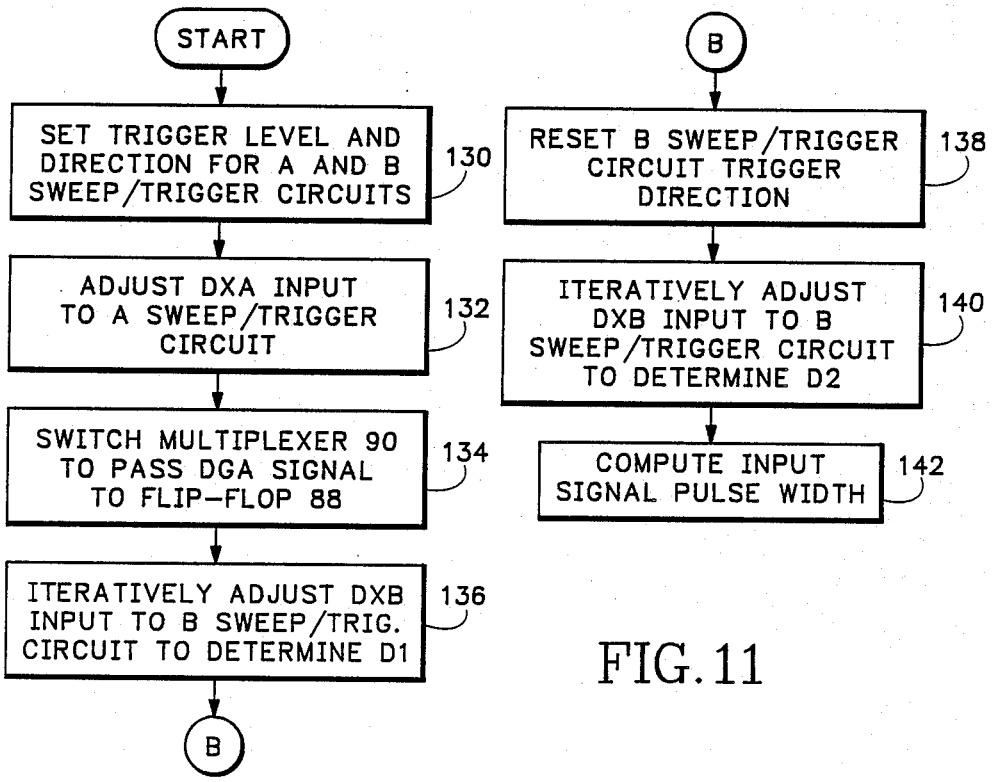

FIG. 11 is a flow chart illustrating operation of the microcomputer to carry out step 106 of the flow chart of FIG. 9 in which it employs the A-same-B interval measurement mode when measuring, for example, the pulse width of a square wave input signal as illustrated in FIG. 6D. The microcomputer sets the trigger level for both A and B sweep/trigger circuits to midway between the high and low peaks of the square wave input signal and initially sets both circuits to trigger as the input signal rises above the trigger level (step 130). The microcomputer also adjusts the control data DXA input to the A sweep/trigger circuit whereby the DGA signal goes high at some time following initiation of the A SWEEP GATE (step 132). The microcomputer switches multiplexer 90 of FIG. 5 to pass the DGA signal to the clock input of flip-flop 88 (step 134). Thereafter, the microcomputer monitors the Q output of latch 82 of FIG. 5 and iteratively adjusts the DXB input to the B sweep/trigger circuit by progressively smaller amounts until it determines a first value D1 for data DXB controlling VREF2B for B sweep/trigger circuit for which the B SWEEP RAMP signal reaches the first pass value of VREF2B at a time as close as possible to the time at which DGA goes positive (step 136).

The microcomputer then sets the B sweep/trigger circuit such that it triggers the B sweep on the falling edge of the input signal while continuing to allow the A sweep/trigger circuit to trigger on the rising edge of the input signal (step 138). The microcomputer again iteratively adjusts the VREF2B signal of the B sweep/trigger circuit until it determines a second value D2 for the data DXB supplied as input the B sweep/trigger signal for which the B SWEEP RAMP signal reaches the second pass level of VREF2B at a time as close as possible to the time at which DGA goes positive (step 140). The microcomputer then computes the input signal pulse width according to expression [1] hereinabove (step 142).

A time interval measurement system for an analog oscilloscope has been described that enables the oscilloscope to make accurate measurement of time intervals between selected level crossing events in an input signal. While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. Apparatus responsive to an input signal for measuring a time interval between two level crossing events in the input signal comprising:

means for generating a first sweep ramp signal, said first sweep ramp signal being initiated when an input signal crosses a predetermined first trigger level;

means for generating a first including signal when said first sweep ramp signal reaches a first reference magnitude;

means for generating a second sweep ramp signal, said second sweep ramp signal being initiated when said input signal crosses a predetermined second trigger level;

means for generating a second indicating signal when said second sweep ramp signal reaches a second reference magnitude; and means for monitoring said first and second indicating signals, and for adjusting one of said first and second reference magnitudes until said first and second indicating signals are generated at substantially the same time; and wherein said means for monitoring and adjusting comprises:

means responsive to said first and second indicating signals for producing a third signal indicating whether said first indicating signal is generated before said second indicating signal; and means for monitoring said third indicating signal and for selectively incrementing or decrementing said second reference magnitude in response to said third indicating signal.

2. Apparatus responsive to an input signal for measuring a time interval between two level crossing events in the input signal comprising:

means for generating a first sweep ramp signal, said first sweep ramp signal being initiated when said input signal first crosses a predetermined first trigger level;

means for generating a first indicating signal when said first sweep ramp signal reaches an adjustable first reference magnitude;

means for generating a second indicating signal when said first sweep ramp signal reaches a second reference magnitude;

means for generating a second sweep ramp signal, said second sweep ramp signal being initiated when said input signal first crosses a predetermined second trigger level after said first indicating signal is generated;

means for generating a third indicating signal when said second sweep ramp signal reaches an adjustable third reference magnitude; and control means for adjusting said first reference magnitude, for monitoring said first and third indicating signals, and for iteratively adjusting said third reference magnitude until said first and third indicating signals are generated at substantially the same time.

3. Apparatus in accordance with claim 2 wherein said control means comprises:

means responsive to said first and third indicating signals for producing a fourth signal indicating whether said first signal is generated before said third indicating signal; and means for adjusting said first reference magnitude, for monitoring said fourth indicating signal, and for selectively incrementing or decrementing said third reference magnitude in response to said fourth indicating signal.

4. Apparatus responsive to an input signal for measuring a time interval between two level crossing events in the input signal comprising:

means for generating a first sweep ramp signal, said first sweep ramp signal being initiated when said input signal first crosses a predetermined first trigger level;

means for generating a first indicating signal when said first sweep ramp signal reaches an adjustable first reference magnitude;

means for generating a second indicating signal when said first sweep ramp signal reaches a second reference magnitude;

means for generating a second sweep ramp signal, said second sweep ramp signal being initiated when said input signal first crosses a predetermined second trigger level after said first indicating signal is generated;

means for generating a third indicating signal when said second sweep ramp signal reaches an adjustable third reference magnitude; and control means for adjusting said first reference magnitude, for monitoring said first, second and third indicating signals, and for iteratively adjusting said third reference magnitude until one of said first and second indicating signals is generated at substantially the same time as said third indicating signal.

5. Apparatus in accordance with claim 4 wherein said control means comprises:

switch means for generating an output signal in response to generation of one of said first and second signals selected in accordance with a control signal;

means responsive to said output signal for producing a fourth indicating signal indicating whether said output signal is generated before said third indicating signal; and means for generating said control signal, for adjusting said first reference magnitude, for monitoring said fourth indicating signal, and for selectively incrementing or decrementing said third reference magnitude in response to said fourth indicating signal.

6. A method of operation of an oscilloscope for measuring a time interval between two level crossing events in an input signal, the method comprising the steps of:

repetitively generating a first sweep ramp signal, said first sweep ramp signal being initiated when said input signal first crosses a predetermined first trigger level;

generating a first indicating signal when said first sweep ramp signal reaches a first reference magnitude of a first value;

generating a second indicating signal when said first sweep ramp signal reaches a second reference magnitude;

generating a second sweep ramp signal, said second sweep ramp signal being initiated when said input signal first crosses a predetermined second trigger level after said first including signal is generated;

generating a third indicating signal when said second sweep ramp signal reaches an adjustable third reference magnitude;

monitoring said second and third indicating signals, and iteratively adjusting said third reference magnitude to a first level at which said second and third indicating signals are generated at substantially the same time;

adjusting said first reference magnitude to a second value differing from said first value;

repetitively generating said first sweep ramp signal, said first sweep ramp signal being initiated when said input signal again crosses said predetermined first trigger level;

generating said first indicating signal when said first sweep ramp signal reaches said first reference magnitude of said second value;

generating said second indicating signal when said first sweep ramp signal reached said second reference magnitude;

generating said second sweep ramp signal, said second sweep ramp signal being initiated when said input signal first crosses aaid predetermined second trigger level after said first indicating signal is generated;

generating said third indicating signal when said second sweep ramp signal reaches said third reference magnitude;

monitoring said second and third indicating signals, and iteratively adjusting said third reference magnitude to a second level at which said second and third indicating signals are generated at substantially the same time; and determining said time interval in accordance with a difference between said iteratively adjusted first and second levels of said third reference magnitude.

7. A method of operation of an oscilloscope for measuring a time interval between two level crossing events in an input signal, the method comprising the step of:

repetitively generating a first sweep ramp signal, said first sweep ramp signal being initiated when said input signal first crosses a predetermined first trigger level;

generating a first indicating signal when said first sweep ramp signal reaches a first reference magnitude;

generating a second initiating signal when said first sweep ramp signal reaches a second reference magnitude;

generating a second sweep ramp signal, said second sweep ramp signal being initiated when said input signal first crosses the predetermined first trigger level;

generating a third indicating signal when said second sweep ramp signal reaches a third reference magnitude; and monitoring said first and third indicating signals and iteratively adjusting said third reference magnitude to a first level at which said first and third indicating signals are generated at substantially the same time;

generating a second sweep ramp signal, said second sweep ramp signal being initiated when said input signal first crosses said predetermined second trigger level;

generating a third indicating signal when said second sweep ramp signal reaches said third reference magnitude;

monitoring said first and third indicating signals and iteratively adjusting said third reference magnitude to a second level at which said first and third indicating signals are generated at substantially the same time; and determining said time interval in accordance with a difference between said iteratively adjusted first and second levels of said third reference magnitude.

* * * * *